US007938172B2

(12) United States Patent
Yabe et al.

(10) Patent No.: US 7,938,172 B2
(45) Date of Patent: May 10, 2011

(54) HEAT EXCHANGER

(75) Inventors: Takashi Yabe, Oyama (JP); Hiroyuki Sudo, Oyama (JP); Takashi Hirayama, Oyama (JP)

(73) Assignee: Showa Denko K.K., Tokyo (JP)

( * ) Notice: Subject to any disclaimer, the term of this patent is extended or adjusted under 35 U.S.C. 154(b) by 1165 days.

(21) Appl. No.: 11/616,130

(22) Filed: Dec. 26, 2006

(65) Prior Publication Data

US 2007/0144714 A1 Jun. 28, 2007

(30) Foreign Application Priority Data

Dec. 27, 2005 (JP) ..... 2005-374211

(51) Int. Cl.
*F28D 1/02* (2006.01)

(52) U.S. Cl. ..... 165/152; 165/153

(58) Field of Classification Search ..... 165/152, 165/153

See application file for complete search history.

(56) References Cited

U.S. PATENT DOCUMENTS

| | | | | |
|---|---|---|---|---|
| 5,311,935 | A * | 5/1994 | Yamamoto et al. | 165/153 |
| 5,564,497 | A * | 10/1996 | Fukuoka et al. | 165/153 |
| 6,170,566 | B1 * | 1/2001 | Blumel et al. | 165/153 |
| 6,672,376 | B2 * | 1/2004 | Shembekar et al. | 165/153 |
| 6,805,193 | B2 * | 10/2004 | Hu et al. | 165/152 |
| 7,428,920 | B2 * | 9/2008 | Antonijevic | 165/152 |
| 7,500,309 | B2 * | 3/2009 | Lang et al. | 165/152 |
| 2002/0195235 | A1 * | 12/2002 | Falta et al. | 165/152 |
| 2004/0251004 | A1 * | 12/2004 | Stoynoff, Jr. | 165/153 |
| 2006/0266503 | A1 * | 11/2006 | Yamauchi | 165/152 |
| 2007/0068661 | A1 * | 3/2007 | Yabe et al. | 165/152 |
| 2007/0068662 | A1 * | 3/2007 | Yabe et al. | 165/152 |

FOREIGN PATENT DOCUMENTS

| | | |
|---|---|---|
| JP | 2000-154989 | 6/2000 |
| JP | 3459271 | 8/2003 |

OTHER PUBLICATIONS

U.S. Appl. No. 11/526,634, filed Sep. 26, 2006, Yabe, et al.
U.S. Appl. No. 11/526,743, filed Sep. 26, 2006, Yabe, et al.
U.S. Appl. No. 11/616,130, filed Dec. 26, 2006, Yabe, et al.

* cited by examiner

*Primary Examiner* — Ljiljana (Lil) V Ciric
(74) *Attorney, Agent, or Firm* — Oblon, Spivak, McClelland, Maier & Neustadt, L.L.P.

(57) ABSTRACT

A heat exchanger includes a pair of header tanks, a plurality of flat heat exchange tubes which are disposed between the two header tanks and whose opposite end portions are connected to the corresponding header tanks, and a plurality of corrugate fins each including wave crest portions, wave trough portions, and connection portions connecting together the corresponding wave crest portions and wave trough portions, and each disposed between the adjacent heat exchange tubes. Each connection portion has a plurality of louvers which extend in a width direction of the connection portion and are arranged in a longitudinal direction of the connection portion. The louver pitch is 0.4 mm to 0.8 mm. The inclination angle of the louvers in relation to the connection portion is 20° to 30°.

2 Claims, 4 Drawing Sheets

HEAT EXCHANGER

BACKGROUND OF THE INVENTION

The present invention relates to a heat exchanger preferably used as, for example, a heater core to be incorporated into a car air conditioner for a vehicle.

Herein and in the appended claims, the term "aluminum" encompasses aluminum alloys in addition to pure aluminum.

A heater core for a car air conditioner is a heat exchanger for heating the interior of a vehicle compartment by making use of warm cooling water for cooling an engine. In recent years, the temperature of the cooling water has decreased, because of improved performance of a radiator and a decrease in heat generation attributable to improved engine performance. Therefore, in order to satisfactorily heat the interior of the vehicle compartment, the performance of the heater core must be further enhanced.

A conventionally known heater core for use in a car air conditioner includes a pair of header tanks spaced apart from each other; a plurality of flat heat exchange tubes which are disposed between the two header tanks at predetermined intervals along a longitudinal direction of the header tanks with their width direction coinciding with an air flow direction and whose opposite end portions are connected to the corresponding header tanks; and a plurality of corrugate fins each including wave crest portions, wave trough portions, and flat connection portions connecting together the corresponding wave crest portions and wave trough portions, and each disposed between the adjacent heat exchange tubes. Each connection portion of each corrugate fin has a plurality of louvers which extend in the width direction of the connection portion and arranged in the longitudinal direction of the connection portion. In this heater core, the tube height of the heat exchange tube (thickness along the longitudinal direction of a header) is between 1.4 mm to 1.8 mm; the thickness of an elongated aluminum sheet used to form the heat exchange tube, or the tube wall thickness of the heat exchange tube, is 0.4 mm; the inner height of the heat exchange tube (tube height−tube wall thickness×2) is 0.6 mm to 1.0 mm; the width of the corrugate fin as measured in the air flow direction is between 21 mm to 32 mm; and the fin height of the corrugate fin, or the direct distance between the wave crest portion and the wave trough portion, is 2.5 mm to 5.0 mm (refer to Japanese Patent No. 3459271 (claim 1, paragraph 0012, and paragraph 0017)).

In the case of the heater core described in the publication, the performance of the heater core is improved by setting within respective ranges the tube height of the heat exchange tube, the tube wall thickness of the heat exchange tube, the inner height of the heat exchange tube, the width of the corrugate fin as measured in the air flow direction, and the fin height of the corrugate fin.

In order to optimize heat radiation and resistance to air flow, which are performance factors of a heater core, the inventors of the present invention focused on the louver pitch (the pitch of the louvers formed on each connection portion of each corrugate fin) and the inclination angle of the louvers in relation to the connection portion, and have thus achieved the present invention.

SUMMARY OF THE INVENTION

An object of the present invention is to solve the above problem and to provide a heat exchanger which, when used as a heater core, exhibits excellent heat radiation performance and has low resistance to air flow.

To achieve the above object, the present invention comprises the following modes.

1) A heat exchanger comprising:

a pair of header tanks spaced apart from each other;

a plurality of flat heat exchange tubes which are disposed between the two header tanks at predetermined intervals along a longitudinal direction of the header tanks with their width direction coinciding with an air flow direction and whose opposite end portions are connected to the corresponding header tanks; and a plurality of corrugate fins each including wave crest portions, wave trough portions, and connection portions connecting together the corresponding wave crest portions and wave trough portions, and each disposed between the adjacent heat exchange tubes, each connection portion having a plurality of louvers which extend in a width direction of the connection portion and are arranged in a longitudinal direction of the connection portion, wherein the louver pitch (the pitch of the louvers formed on each connection portion of each corrugate fin) is 0.4 mm to 0.8 mm.

2) A heat exchanger according to par. 1), wherein the inclination angle of the louvers in relation to the connection portion is 20° to 30°.

3) A heat exchanger according to par. 1), wherein the wave crest and wave trough portions of each corrugate fin each have a semicircular transverse cross section, and the following relation is satisfied:

$$Hf=D+2R$$

where Hf represents a fin height of the corrugate fin, which is the direct distance between the wave crest portions and the wave trough portions, D represents the length of the louvers, and R represents the curvature radius of the wave crest and wave trough portions in the transverse cross section.

4) A heat exchanger according to par. 1), wherein the width of each heat exchange tube as measured in the air flow direction is 24 mm to 30 mm.

The heat exchanger of par. 1) or 2), when used as a heater core of a car air conditioner, exhibits excellent heat radiation performance and prevents an increase in resistance to air flow.

The heat exchanger of par. 3) or 4) enhances the effect yielded by the heat exchanger of par. 1).

DESCRIPTION OF THE PREFERRED EMBODIMENT

An embodiment of the present invention will next be described in detail with reference to the drawings. The present embodiment is an application of a heat exchanger of the present invention to a heater core of a car air conditioner.

Figure 1:
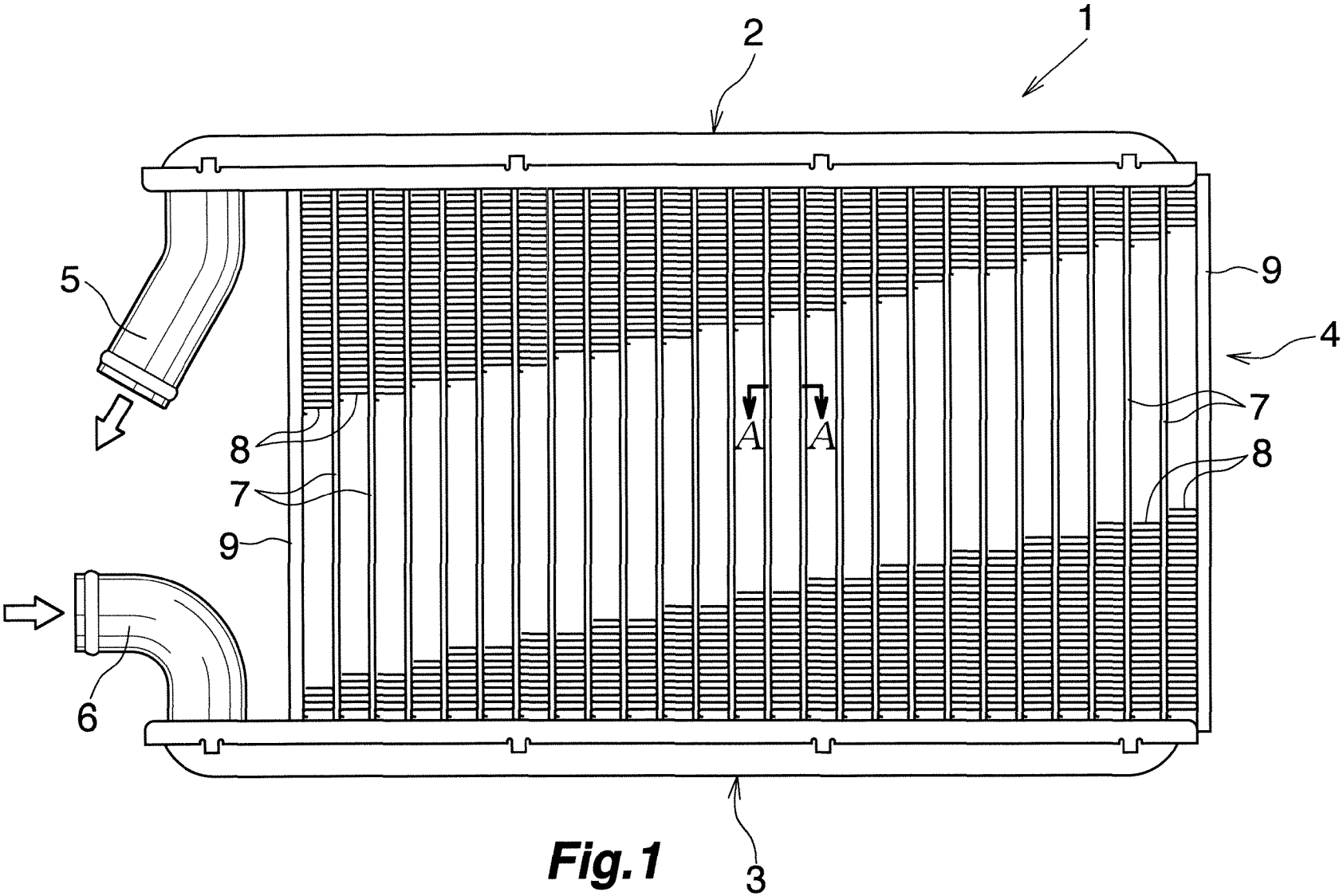
FIG. 1 is a front view showing the overall configuration of a heater core for a car air conditioner to which a heat exchanger of the present invention is applied.

The upper, lower, left-hand, and right-hand sides of FIG. 1 will be referred to as "upper," "lower," "left," and "right," respectively. The far side of the paper on which FIG. 1 appears (the upper side of FIG. 2) is referred to as the "front," and the opposite side as the "rear."

Figure 2:
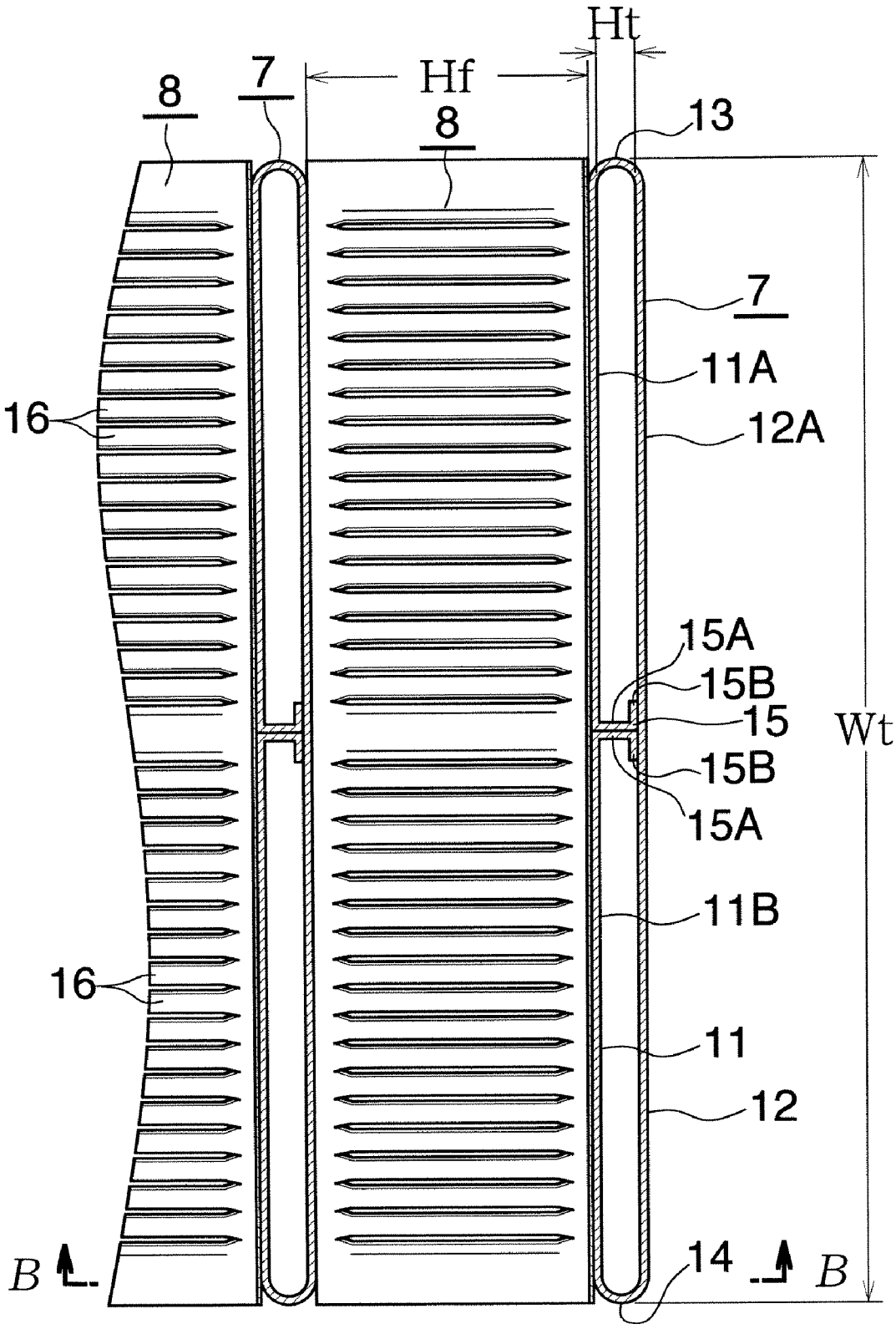
FIG. 2 is an enlarged sectional view taken along line A-A of FIG. 1.
Figure 3:
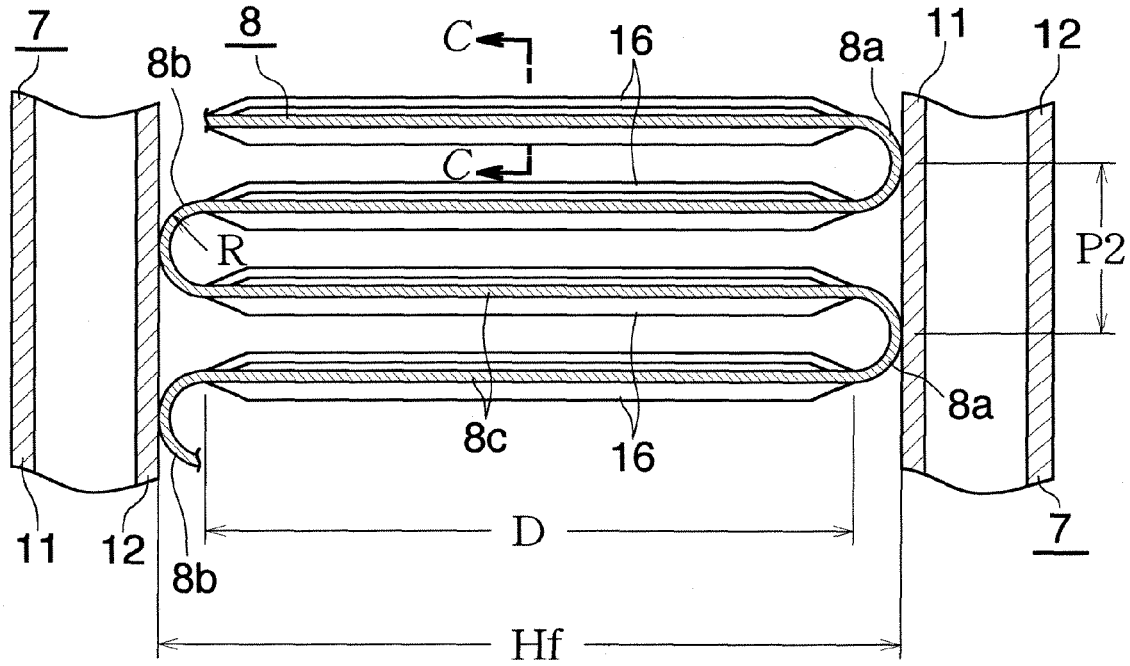
FIG. 3 is an enlarged sectional view taken along line B-B of FIG. 2.

FIG. 1 shows the general configuration of a heater core for a car air conditioner to which a heat exchanger of the present invention is applied. FIGS. 2 and 3 show the configuration of essential portions of the heater core.

In FIG. 1, a heater core 1 includes an upper header tank 2 and a lower header tank 3 which are made of aluminum, are vertically spaced apart from each other, and are elongated in the left-right direction, and a heat exchange core section 4 provided between the upper and lower header tanks 2 and 3.

Left end portions of the upper and lower header tanks 2 and 3 project leftward beyond the heat exchange core section 4. An outlet pipe 5 is connected to a leftward-projecting portion of the upper header tank 2, and an inlet pipe 6 is connected to a leftward-projecting portion of the lower header tank 3.

The heat exchange core section 4 includes a plurality of flat heat exchange tubes 7 made of aluminum which are disposed at predetermined intervals along the left-right direction with their width direction coinciding with the front-rear direction (air flow direction) and whose upper and lower end portions are connected to the upper and lower header tanks 2 and 3, respectively; a plurality of corrugate fins 8 made of aluminum which are each disposed between the adjacent heat exchange tubes 7 and outside the leftmost and rightmost heat exchange tubes 7 and are brazed to the heat exchange tubes 7; and two side plates 9 disposed outside and brazed to the corresponding leftmost and rightmost corrugate fins 8. The upper and lower end portions of the heat exchange tubes 7 are brazed to the upper and lower header tanks 2 and 3, respectively, while being inserted into corresponding tube insertion holes (not shown) formed in the upper and lower header tanks 2 and 3.

As shown in FIG. 2, each heat exchange tube 7 is formed by tubularly bending an elongated aluminum brazing sheet having a brazing material layer on at least one side thereof, in such a manner that the brazing material comes to the outside. The heat exchange tube 7 includes left and right walls 11 and 12 facing each other (a pair of flat walls); front and rear side walls 13 and 14 extending between the front side ends and between the rear side ends, respectively, of the left and right walls 11 and 12; and a reinforcement wall 15 extending between central portions with respect to a width direction of the left and right walls 11 and 12. The right wall 12 is formed of a single right-wall-forming portion 12A. The left wall 11 is formed of two left-wall-forming portions 11A and 11B. The left-wall-forming portions 11A and 11B are integral with the front and rear side ends, respectively, of the right-wall-forming portion 12A via the front and rear side walls 13 and 14, respectively. Side ends, located on a side opposite the side walls 13 and 14, of the left-wall-forming portions 11A and 11B butt against each other. The reinforcement wall 15 is formed of two reinforcement-wall-forming portions 15A which are formed integrally with the corresponding butting side ends of the left-wall-forming portions 11A and 11B and in such a manner as to project rightward and whose projecting end portions abut and are brazed to the right-wall-forming portion 12A. Two bend portions 15B are formed integrally with corresponding projecting ends (right ends) of the two reinforcement-wall-forming portions 15A and in such a manner as to extend toward the corresponding side walls 13 and 14, and are brazed to the right-wall-forming portion 12A.

It is preferred that the width Wt of the heat exchange tube 7 as measured in the front-rear direction is 24 mm to 30 mm, and the inner height Ht of the heat exchange tube 7; i.e., the direct distance between the inner surfaces of the left and right walls 11 and 12 as measured in a region where the bend portions 15B are absent, is 0.7 mm to 1.2 mm. When the width Wt of the heat exchange tube 7 as measured in the front-rear direction is 24 mm to 30 mm, it is desired that the inner height Ht of the heat exchange tube 7 is 0.8 mm to 1.0 mm. Alternatively, it is preferred that the width Wt of the heat exchange tube 7 as measured in the front-rear direction is 18 mm to 24 mm and the inner height Ht of the heat exchange tube 7 is 1.2 mm to 1.7 mm. When the width Wt of the heat exchange tube 7 as measured in the front-rear direction is 18 mm to 24 mm, it is desired that the inner height Ht of the heat exchange tube 7 is 1.3 mm to 1.5 mm. Irrespective of ranges in which the width Wt and the inner height Ht of the heat exchange tube 7 fall, the wall thickness of the heat exchange tube 7 is preferably set to 0.1 mm to 0.4 mm; for example, 0.2 mm. The wall thickness of the heat exchange tube 7 is determined in consideration of manufacturing constraints and strength requirements.

Figure 4:
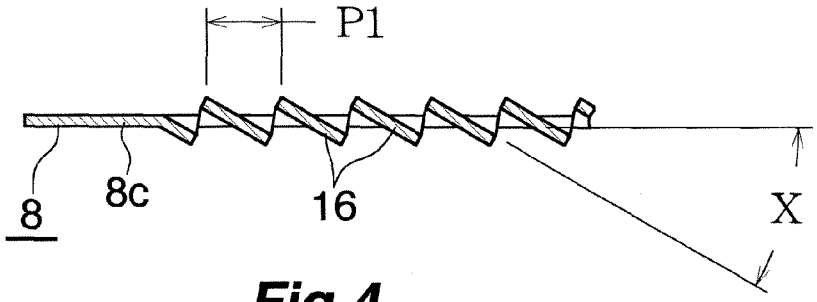
FIG. 4 is a sectional view taken along line C-C of FIG. 3.

As shown in FIGS. 3 and 4, the corrugate fin 8 is formed in a corrugated form from an aluminum brazing sheet having a brazing material layer on each of opposite sides thereof. The corrugate fin 8 includes wave crest portions 8*a* each having a semicircular transverse cross section, wave trough portions 8*b* each having a semicircular transverse cross section, and flat horizontal connection portions 8*c* connecting together the respective wave crest portions 8*a* and wave trough portions 8*b*. Each connection portion 8*c* has a plurality of louvers 16 which extend in the left-right direction (the width direction of the connection portion 8*c*) and are arranged in the front-rear direction (the longitudinal direction of the connection portion 8*c*). The curvature radiuses of the wave crest portions 8*a* and the wave trough portions 8*b* in the transverse cross section are equal to each other. The width of the corrugate fin 8 as measured in the front-rear direction is the same as the width of the heat exchange tube 7 as measured in the front-rear direction. The wave crest portions 8*a* and the wave trough portions 8*b* of the corrugate fins 8 are brazed to the heat exchange tubes 7 and the side plates 9.

The louver pitch P1; i.e., the pitch of the louvers 16 formed at each connection portion 8*c* of each corrugate fin 8, is 0.4 mm to 0.8 mm. The inclination angle X of the louvers 16 in relation to the connection portion 8*c*; i.e., a horizontal plane, is 20° to 30°. When the curvature radius of the wave crest and wave trough portions 8*a* and 8*b* in the transverse cross section is represented by R, the fin height of the corrugate fin 8 (the direct distance between the wave crest portions 8*a* and the wave trough portions 8*b*) is represented by Hf (mm), and the length of each louver 16 is represented by D (mm), it is preferred that Hf=D+2R is satisfied. Notably, when the pitch of the wave crest portions 8*a* and the pitch of the wave trough portions 8*b* are each represented by P2 (mm), R=P2×¼. Further, the thickness of the corrugate fin 8 is preferably set to 0.02 mm to 0.1 mm; for example, to 0.06 mm. The pitch (P2) of the wave crest portions 8*a* and the wave trough portions 8*b* of the corrugate fin 8 and the thickness of the corrugate fin 8 are determined in consideration of manufacturing constraints, strength requirements, and resistance to air flow.

Figure 5:
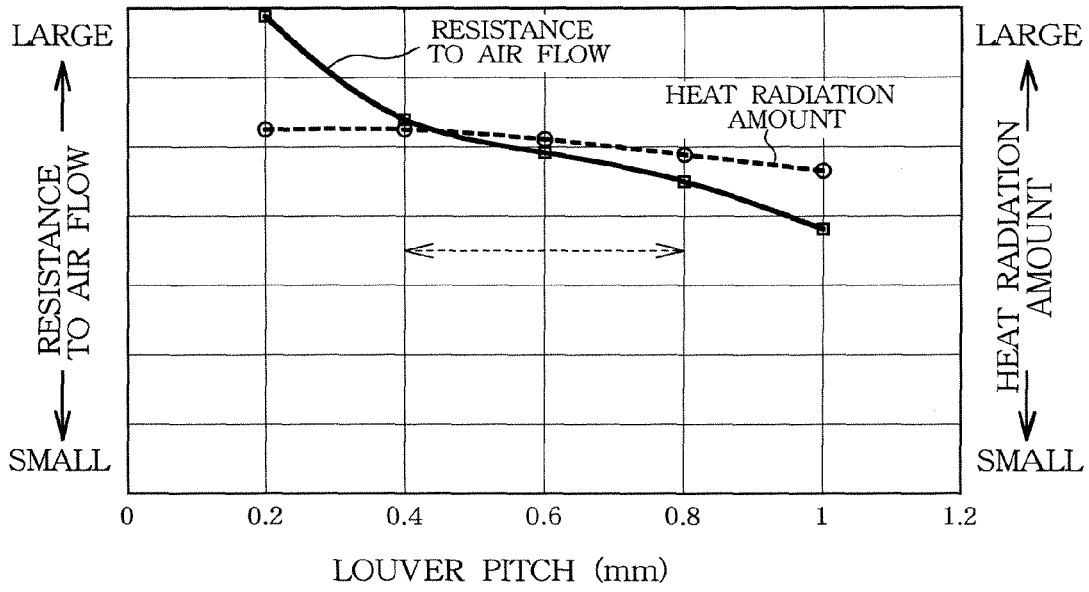
FIG. 5 is a graph of louver pitch vs. heat radiation amount and resistance to air flow.

The louver pitch P1 (the pitch of the louvers 16 formed at each connection portion 8*c* of each corrugate fin 8) is set to 0.4 mm to 0.8 mm in consideration of results shown in FIG. 5 which were obtained through computer simulation calculation. This computer simulation calculation was performed under the following conditions while the louver pitch P1 was varied: the height of the heat exchange core section 4 is 147 mm; the width of the heat exchange core section 4 as measured in the left-right direction is 245 mm; the width Wt of the heat exchange tube 7 as measured in the front-rear direction is 27 mm; the wall thickness of the heat exchange tube 7 is 0.2 mm; the pitch P2 of the wave crest portions 8*a* of the corrugate fin 8 is 1.5 mm; the length D of the louvers 16 is 5.25 mm; the fin height Hf of the corrugate fin 8 is 6 mm; and the thickness of the corrugate fin 8 is 0.06 mm.

The vertical axis of the graph shown in FIG. 5 represents heat radiation amount and resistance to air flow. From the graph of FIG. 5, the louver pitch P1 of the corrugate fin 8 is set to a range of 0.4 mm to 0.8 mm, in which the heat exchanger exhibits desired heat radiation amount and resistance to air flow.

Figure 6:
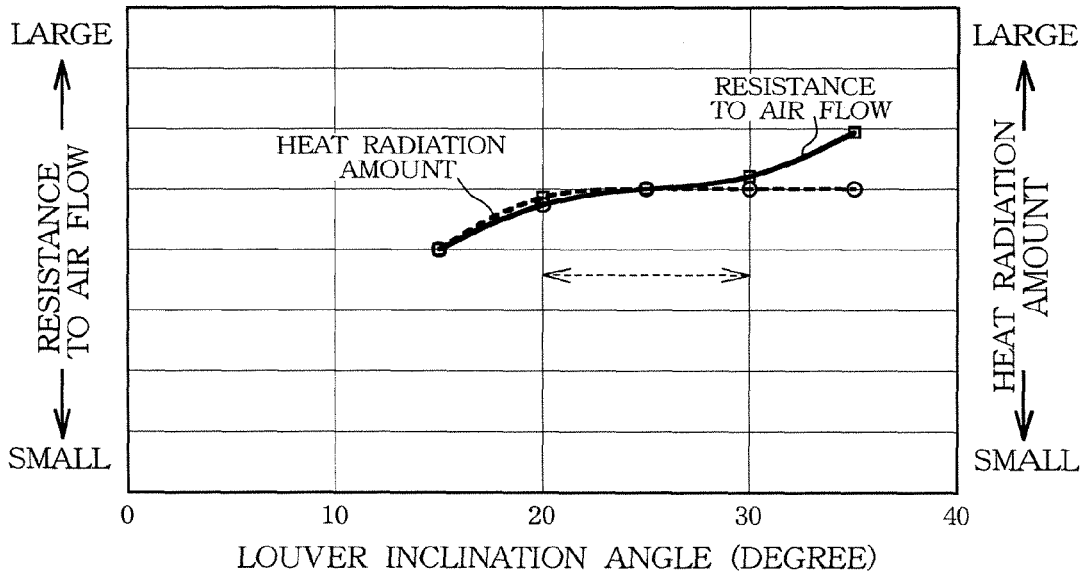
FIG. 6 is a graph of louver inclination angle vs. heat radiation amount and resistance to air flow.

The inclination angle X of the louvers 16 of the corrugate fin 8 in relation to the corresponding connection portion 8*c* is set to 20° to 30° in consideration of results shown in FIG. 6 which were obtained through computer simulation calculation. This computer simulation calculation was performed under the following conditions while the inclination angle X of the louvers 16 was varied: the height of the heat exchange core section 4 is 147 mm; the width of the heat exchange core section 4 as measured in the left-right direction is 245 mm; the width Wt of the heat exchange tube 7 as measured in the front-rear direction is 27 mm; the wall thickness of the heat exchange tube 7 is 0.2 mm; the pitch P2 of the wave crest portions 8*a* of the corrugate fin 8 is 1.5 mm; the length D of the louvers 16 is 5.25 mm; the fin height Hf of the corrugate fin 8 is 6 mm; and the thickness of the corrugate fin 8 is 0.06 mm.

The vertical axis of the graph shown in FIG. 6 represents heat radiation amount and resistance to air flow. From the graph of FIG. 6, the inclination angle X of the louvers 16 of the corrugate fin 8 in relation to the corresponding connection portion 8*c* is set to a range of 20° to 30°, in which the heat exchanger exhibits desired heat radiation amount and resistance to air flow.

In the above-described heater core 1, high-temperature engine-cooling water is transferred from an engine into the lower header tank 3 through the inlet pipe 6. The high-temperature engine-cooling water which has flowed into the lower header tank 3 dividedly flows into the heat exchange tubes 7, flows upward through the heat exchange tubes 7, and then enters the upper header tank 2. The high-temperature engine-cooling water which has flowed into the upper header tank 2 flows out through the outlet pipe 5 and then returns to the engine. Notably, the high-temperature engine-cooling water may be transferred from the engine to the heater core 1 and a radiator or may be transferred from the engine to the radiator only.

What is claimed is:

1. A heater core comprising:

first and second header tanks spaced apart from each other;

a plurality of flat heat exchange tubes which are disposed between the first and second header tanks at predetermined intervals along a longitudinal direction of the header tanks with a width direction of the heat exchange tubes intersecting a longitudinal direction of the header tanks so as to coincide with an air flow direction, and opposite end portions of each heat exchange tube being connected to the first and second header tanks respectively; and a plurality of corrugate fins each being disposed between respective adjacent heat exchange tubes, and each of the plurality of corrugate fins including wave crest portions, wave trough portions, and connection portions connecting together corresponding wave crest portions and wave trough portions, wherein each connection portion having a plurality of louvers which extend in a width direction of the connection portion and are arranged in a longitudinal direction of the connection portion, wherein the pitch of the louvers formed on each connection portion of each corrugate fin is between 0.4 mm to 0.8 mm, wherein an inclination angle of the louvers in relation to the connection portion is 20° to 30°, a thickness of the corrugated fin is 0.02 to 0.1 mm, and wherein the wave crest and wave trough portions of each corrugate fin each have a semicircular transverse cross section, and the following relation is satisfied:

$$Hf=D+2R$$

where Hf represents a fin height of the corrugate fin, which is the direct distance between the wave crest portions and the wave trough portions, D represents the length of the louvers, and R represents the curvature radius of the wave crest and wave trough portions in the transverse cross section.

2. The heater core according to claim 1, wherein the width of each heat exchange tube is between 24 mm to 30 mm, an inner height of the heat tube is 0.7 to 1.2 mm and the wall thickness of the heat exchange tube is 0.1 to 0.4 mm.

* * * * *